United States Patent [19]

Stritzko

[11] 3,960,487

[45] June 1, 1976

[54] LIQUID-TREATING OF FILAMENTARY MATERIALS

[75] Inventor: Vilem Stritzko, Strengelbach, Switzerland

[73] Assignee: Bleiche A.B., Zofingen, Switzerland

[22] Filed: Jan. 9, 1975

[21] Appl. No.: 539,738

[30] Foreign Application Priority Data

Jan. 16, 1974 Switzerland ..... 561/74

[52] U.S. Cl. ..... 8/155.1; 68/150; 68/183; 68/198

[51] Int. Cl.[2] ..... D06B 5/18

[58] Field of Search ..... 8/149.1, 155.1, 155.2, 8/157, 158; 68/5 C, 7, 8, 150, 162, 163, 183, 189, 198, 207

[56] References Cited

UNITED STATES PATENTS

| | | | |
|---|---|---|---|
| 1,948,568 | 2/1934 | Faber et al. | 68/183 X |
| 1,980,413 | 11/1934 | Lewis et al. | 68/189 X |
| 2,023,013 | 12/1935 | Faber et al. | 8/149.1 X |
| 2,872,802 | 2/1959 | Bellmann | 68/150 |
| 2,936,212 | 5/1960 | Karrer | 8/149.1 X |

*Primary Examiner*—Philip R. Coe
*Attorney, Agent, or Firm*—Michael J. Striker

[57] ABSTRACT

To liquid-treat filamentary materials, such as threads, yarns and textiles, a hollow package of the filamentary material is confined within a vessel so that the package subdivides the interior of the vessel in an inner and a separate outer chamber which communicate with one another only through the thickness of the filamentary material. A foamable treating liquid in unfoamed state is admitted into one of the chambers and is pressed into the filamentary material in order to wet the filamentary material with the liquid. The still unfoamed liquid is then discharged from said one chamber and a pressurized gaseous fluid is forced through the package in order to evenly distribute the wetting liquid throughout the package and to foam it at the same time.

15 Claims, 3 Drawing Figures

LIQUID-TREATING OF FILAMENTARY MATERIALS

BACKGROUND OF THE INVENTION

The present invention relates generally to the treating of filamentary materials, and more particularly to the liquid treating of such filamentary materials.

Still more specifically, the invention relates to a novel method of liquid treating filamentary materials, and to an apparatus for carrying out the method.

Filamentary materials as the term is employed herein encompass filaments, threads, yarns and textiles made from any of these. Such materials are often required to be liquid treated, for example to be washed, to be dyed, to be sized or for other purposes.

One approach known from the prior art to achieve these purposes is discussed, for example, in "Verfahrenstechnik der Textilveredelung" Paul Senner, Konradin-Verlag Robert Kohlhammer GmbH, Stuttgart, Germany. According to this approach, a liquid treading medium is forced through a package of the filamentary material either in inward or in outward direction. This, however, requires a substantial expenditure of energy, a long treating time and a disadvantage treating liquid ratio.

Another approach known from the prior art purposes to spray treating liquid in foamed condition onto the filamentary material and during this time to agitate the filamentary material mechanically in a drum. This approach requires less energy than the first-mentioned one, but it has the disadvantage that it is not suitable for treating of yarns and textile yard goods, so that it is restricted to use with finished garments and the like.

SUMMARY OF THE INVENTION

Accordingly, it is a general object of this invention to overcome the aforementioned disadvantages.

More particularly, it is an object of the invention to provide an improved method of liquid-treating filamentary materials, such as threads, yarn and textiles, which requires less treating liquid, less treating time and less energy to carry it out.

Another object of the invention is to provide such an improved method which also produces a finished product of superior quality.

Another object of the invention is to provide an apparatus for carrying out the novel method.

In keeping with these objects, and with others which will become apparent hereafter, one feature of the invention resides in a method of liquid-treating filamentary materials, such as threads, yarn and textiles, which comprises the steps of confining a hollow package of filamentary material within a vessel so that the package subdivides the interior of the vessel in an inner and a separate outer chamber which communicate only through the thickness of the filamentary material. A foamable treating liquid is admitted in unfoamed state into one of the chambers, and the liquid is then pressed into the filamentary material in order to thereby wet the filamentary material. The still unfoamed liquid is then discharged from the said one chamber, and a pressurized gaseous fluid is forced through the package to thereby foam the liquid with which the filamentary material is wetted and to evenly distribute it throughout the package.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
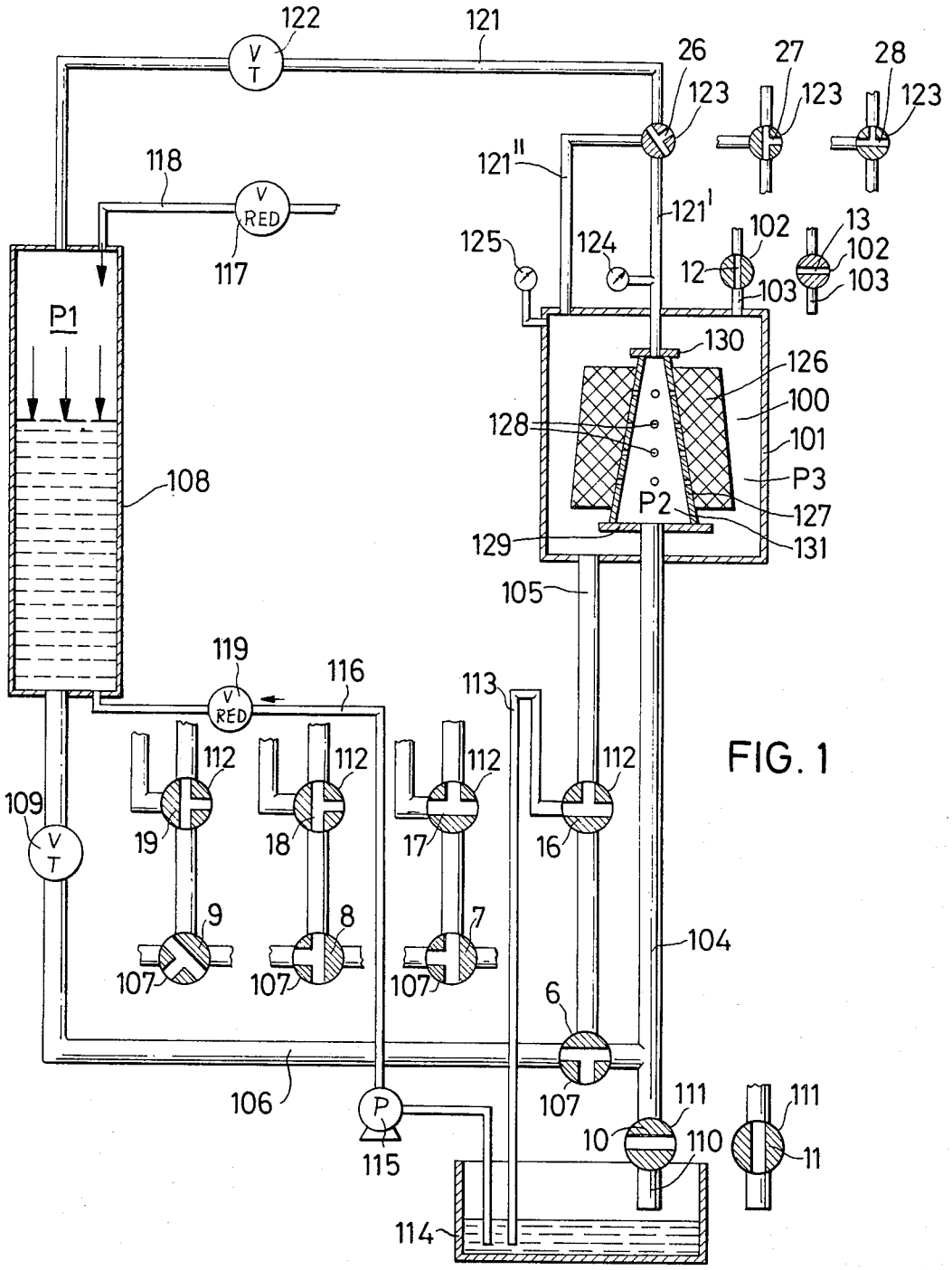
FIG. 1 is a diagrammatic vertical section through an apparatus according to the present invention, showing at the right-hand corner some separate operating positions of the associated valves.

Referring to the drawing in detail it is first emphasized that in all embodiments the reference character P2 identifies the pressure of the treating liquid or the compressed air immediately ahead of the filamentary material to be treated, whereas P3 identifies the pressure in the treating liquid or the compressed air immediately behind the filamentary material to be treated.

With this in mind, reference will now be first made to the embodiment in FIG. 1 wherein reference numeral 101 identifies a vessel having an interior 100 which communicates with a discharge conduit 103 which is controlled by a valve 102. A first fluid line 104 and a second fluid line 105 both communicate with the vessel 101 and are connected via a three-way valve 107 with a third fluid line 106 which communicates with the bottom of a treating liquid reservoir 108. A throttle valve 109 is mounted in the third fluid line 106. A first return line 110 is connected with the line 104 via a blocking valve 111. A three-way valve 112 connects the line 105 with a second return line 113. Both lines 110 and 113 lead to a treating liquid reservoir 114 from which the treating liquid can be forwarded to the reservoir 108 via a pump 115 and a fluid line 116 in which a reduction valve 119 is interposed.

A compressed air line 118 with a reduction valve 117 interposed in it connects the reservoir 108 with a source of compressed air that is not illustrated. A compressied air line 121 has a throttle valve 122 interposed in it as well as a three-way valve 123; it connects the upper end of the reservoir 108 via branch conduits 121' and 121'' with the interior chamber 131 formed within the bobbin 127 and also with the interior 100 in the vessel 101. Pressure gauges 124 and 125 are interposed in the branch conduits 121' and 121'', respectively, to indicate the pressures prevailing in the chambers 131 and 100.

If a thread or yarn is the filamentary material to be treated, then it is formed to the configuration of a hollow package 126 on a bobbin tube 127 which has holes 128 in its circumferential wall. This package is then pushed onto a plate 129 which closes one of its ends whereas the upper end is closed by a cover 130 through which the branch conduit 121' extends to communicate with the chamber 131. The line 104 also communicates with the chamber 131.

If a textile material, such as a length of yard goods, is to be liquid treated, then it will be formed into a package that is placed on a member analogous to the bobbin tube 127 and which member will then be put in place instead of the bobbin tube 127.

The pump 115 draws the desired quantity of treating liquid from the reservoir 114 and forwards it via the line 116 into the reservoir 108. The treating liquid has admixed with it a foam-producing agent of the type that is conventional in this art and therefore well enough known so as not to require description. The action of such foam producing agent is that when air is blown through the treating liquid containing the foam producing agents, foam will develop. This will be discussed in more detail subsequently but at the moment it is sufficient to point out that after the desired quantity of the treating liquid has been transferred from the reservoir 114 to the reservoir 108, the reduction valve 117 is set until a cushion of compressed air having a pressure P1 is produced in the reservoir 108 above the level of treating liquid therein.

FIRST OPERATING STEP

To carry out the first operating step the valve 102, the valve 103, the valve 111, the valve 112 and the valve 123 are set to the positions 12, 6, 10, 16 and 26, respectively, which are illustrated in FIG. 1. The line 105 is blocked with respect to the line 106, and the line 110 is blocked with respect to the line 104. The lines 121' and 121'' are closed and the line 103 is open. The valve 109 is open and the compressed air at the pressure P1 in the reservoir 108 presses the treating liquid from the reservoir 108 through the reducing valve 109 via the line 106 and the line 104 into the chamber 131. From there, the liquid penetrates through the holes 128 into the filamentary material package 126. As this proceeds, the pressure P2 which prevails in the chamber 131 and can be determined by an inspection of the gauge 124, rises to a preselected value which is determined by the hydrodynamic resistance in the package 126. Due to the largely laminar flow of the liquid in the lines 106 and 104 the liquid will not form any foam in the chamber 131, despite the fact that a foaming agent has been added to it.

Once the preselected pressure in chamber 131 has been reached, the next operating step can be undertaken.

SECOND OPERATING STEP

The valves 102, 107, 111, 112 and 123 are now moved to the positions 13, 7, 11, 17 and 27, respectively, which are also shown in FIG. 1. In these settings the line 104 is blocked with respect to the line 106 but connected with the line 110. The line 103 is blocked and the line 121 is connected with the branch line 121' and via the same with the chamber 131. Compressed air now flows from the reservoir 108 via the line 121 into the chamber 131 and blows the liquid therein via the lines 104 and 110 into the reservoir 114, thereby removing liquid from the chamber 131.

The apparatus is now ready for the third operating step.

THIRD OPERATING STEP

To initiate the third operating step the valve 102, 107, 111, 112 and 123 are moved to the positions 13, 7, 10, 17 and 27, respectively, as shown in FIG. 1. When this is done, the line 103 is blocked and the line 104 is blocked with respect to the line 106 and to the line 110. The line 105 continues to be connected with the line 113.

During this step the pressure P2 prevailing in the chamber 131 is greater than the pressure P3 which prevails in the interior 100 of the vessel 101. Due to this differential pressure the air from the chamber 131 passes through the openings 128 and through the package 126 of filamentary material, and enters into the interior 100 of the vessel 101, from it can flow out through the line 105. It will be appreciated from the previous description that the only communication between the interior 100 and the chamber 131 is via the openings 128 and the thickness of the filamentary material on the bobbin tube 127, since communication at the opposite axial ends of the bobbin tube is prevented by the presence of the plate 129 and the cover 130.

During its passage through the inner layers of filamentary material in the package 126, the compressed air causes the liquid that has been retained therein and wetted the filamentary material, to undergo foaming and distribute the liquid in foamed condition throughout the entire cross-section of the package 126. In the same measure in which the compressed air distributes the now foamed treating liquid throughout the passage 126, the pressure P2 will drop in the chamber 131 and thereby the pressure difference P2–P3 between chamber 131 and interior 100 will decrease to a minimum which is determined by the aerodynamic assistance of the package 126 and by the setting of the throttle valve 122.

During this operation the reduction valve 117 assures that the pressure P1 of the air cushion in the reservoir 108 remains constant. When the aforementioned pressure differential P2–P3 between the chamber 131 and the interior 100 has reached the aforementioned minimum value, the next or fourth operating step can be initiated.

FOURTH OPERATING STEP

To begin the fourth operating step the valve 102, 107, 111, 112 and 123 are moved to the positions 12, 8, 11, 18 and 26, respectively. The valve 107 now blocks the line 106 with respect to the line 104 and communicates the same with the line 105 which in turn is blocked with respect to the return flow line 113 by the valve 112. The line 104 is connected with the return flow line 110. The lines 121' and 121'' are blocked by the valve 123. The line 103 is open.

The air pressure P1 in the reservoir 108 now presses the treating liquid from the reservoir 108 via the reducing valve 109, the line 106 and the line 105 into the interior 100 of the vessel 101. As soon as the level of liquid in the vessel 101 is higher than the package 126, the valve 102 is moved to the position 13 and the line 103 is blocked. The treating liquid now penetrates from the exterior (i.e. from the interior 100) into the package 126, and during this the pressure P2 which now prevails in the interior 100, increases until the pressure differential P2–P3 between the interior 100 and the chamber 131 has reached a maximum level which is determined by the hydrodynamic resistance of the package 126. These pressures of course are again descernible by the inspection of the gauges 124 and 125. When the pressure difference P2–P3 has reached the previously mentioned maximum level, the next operating step is initiated.

FIFTH OPERATING STEP

For the fifth operating step the valves 102, 107, 111, 112 and 123 are set to the positions 13, 7, 10, 17 and 28, respectively. This causes the line 105 to be connected with the line 113 whereas the line 104 is blocked with respect to the lines 106 and 110. The line 103 is blocked. The line 121' is blocked with respect to the line 121, but the latter is connected with the line 121''.

The compressed air which enters into the space 100 via the lines 121' and 121'' presses the liquid from the vessel 101 through the line 105 and the line 113 into the reservoir 114, whereupon the next operating step can be initiated.

SIXTH OPERATING STEP

To initiate this step the valves 102, 107, 111, 112 and 123 are moved to the positions 13, 9, 11, 19 and 28, respectively. This results in the lines 103 and 105 being blocked. The line 104 is open and connected with the line 110. The line 121' remains blocked with respect to the line 121, whereas the latter remains connected with the line 121''. This results in an increase in the pressure P2 in the space 100 and the compressed air penetrates the package 126 to enter the chamber 131. In so doing, it causes the treating liquid that has wetted the interior of the package 126, to undergo foaming and distributes this foam uniformly and homogenously over the cross-section of the package 126.

Depending upon the particular requirements of a given application, for example depending upon the dye quality which it may be desired to obtain, it may be sufficient if only the operating steps 1–3 or 4–6 are carried out. It is equally possible to begin with the operating steps 4–6 and thereupon to follow this with the operating steps 1–3, or to carry out the steps 1–3, follow this with the steps 4–6 and once again carry out the steps 1–3, etc. The same is true, of course, if the operation begins with the steps 4–6.

Figure 2:
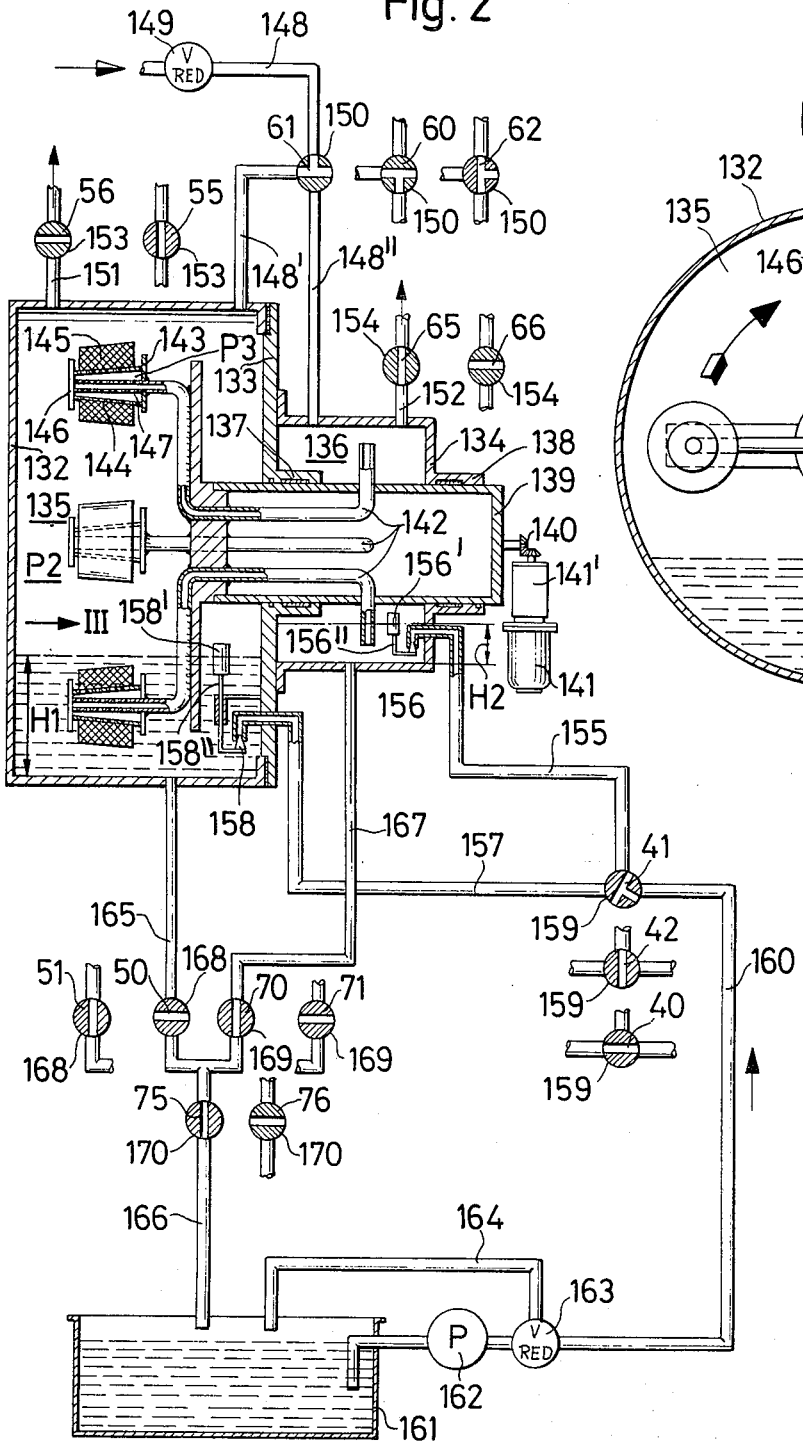
FIG. 2 is a view analogous to FIG. 1, but illustrating a further embodiment of the invention.
Figure 3:
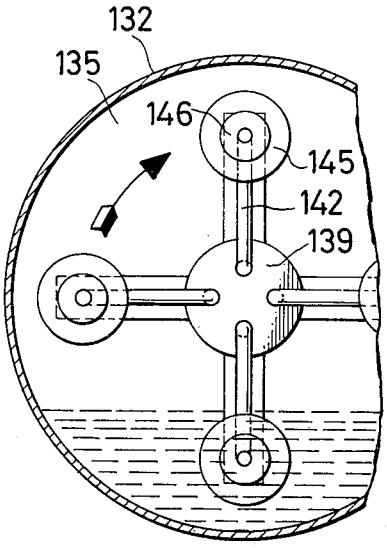
FIG. 3 is a view of FIG. 2, as seen in the direction of the arrow III, with parts omitted for the sake of clarity.

Coming now to FIGS. 2 and 3 it will be seen that these Figures illustrate a further embodiment of an apparatus for carrying out the method. In this embodiment there is provided a first drum 132 which can be closed by a cover 133. Coaxial with reference to the first drum 132 a second drum 134 is provided which is mounted on the cover 133. The interior space within the drum 132 is identified with reference numeral 135; the interior space within the drum 134 is identified with reference numeral 136.

Provided in the cover 133 and in the opposite end wall of the second drum 134 there are provided journals 137 and 138 in axial alignment, in which a hollow shaft 139 is turnably mounted. The shaft 139 can be driven from a drive 141 via a change speed gear 141' and an angle drive 140. Arranged in the shaft 139 in assymetrical relationship are four identical tubes 142 of which only one will be described hereafter, since this description holds true for the others also.

This tube 142 extends with its rear end radially through the wall of the shaft 139 and into the space 139 of the drum 134. The other end of the tube 142 extends into the interior space 135 of the drum 132, radially of the same and is provided with an end portion that is bent over parallel to the axis of the shaft 139. A plate 143 is mounted on this end portion. The wall of the tube portion which projects beyond the plate 143 is formed with holes in the manner of a screen. A dyeing bobbin or sleeve 144 which is also provided with holes and which carries a yarn package 145, is pushed over the end portion of the tube 142 and engages the plate 143 with its wider end. A closure plate 146 is removably connectable with the end portion of the tube 142 and closes the interior of the tube 142 against the interior 135 of the drum 132, at the same time pressing the sleeve 144 against the plate 143 so that the sleeve 144 is held in place between the plate 146 and the plate 143. The sleeve 144 surrounds an interior hollow chamber 147 which is connected with the interior of the tube 142 via the holes in the end portion of the tube 142.

A source of compressed air is not illustrated, but is connected via a line 148 with a reducing valve 149 and a three-way valve 150 with the interior 135 of a first 132 via a branch line 148', and on the other hand with the interior 136 of the drum 134 via a branch line 148''. Two discharge lines 151 and 152 are each provided with a blocking valve 153 and 154 to purge the interiors 135 and 136, respectively.

A line 155 communicates with the interior 136 of the drum 134 and its inner open end can be closed by a float valve 156 which closes the inner open end of the line 155 when the level of a treating liquid admitted into the drum 134 reaches the broken line upper level H2. The float 156' of the valve 156 can be axially shifted on the float rod 156'' and arrested in every position. Thus, by adjusting the float 156' on the rod 156'' the level H2 can be adjusted.

A second line 157 communicates with the interior 135 of the drum 132 and its inner open end can be closed by a float valve 158 when the level of treating liquid admitted into the drum 132 reaches the upper level H1. The float 158' of the valve 158 is also axially shiftable on the float rod 158'' and arrestable in each position, so that the level H' can be adjusted by shifting the float 158' on the float rod 158''.

The lines 155 and 157 are connected with a line 160 via a three-way valve 159. The line 160 in turn is connected with a liquid reservoir 161 which contains the treating liquid that is required for washing dying or otherwise liquid treating of the filamentary material. A pump is interposed in the line 160 so that the liquid can be selectively transported into the drums 132 or 134 from the reservoir 161. A reducing valve 163 is arranged in a return flow line 164, intermediate the pump 162 and the three-way valve 159. A return flow line 165 leads from the bottom of the drum 132 to a collecting conduit 166 with which also a return flow line 167 communicates that is connected to the lowest point of the drum 134. The drums 132 and 134 can discharge their liquid into the reservoir 161 via the lines 165, 167 and the conduit 166. The lines 165 and 167 can each be blocked by a valve 168 and 169, respectively, and the conduit 166 can be blocked by a valve 170.

When filamentary material packages 145 are to be liquid treated, the packages 145 are placed onto the ends of the tubes 142 in the manner shown in FIGS. 2 and 3 and the drum 132, and then held in place with the plates 146, so that the chamber 147 is separated with respect to the chamber 145 (i.e. the interior of the drum 132) by the thickness of the filamentary material of the package 145. Thereafter the drive 141 is started so that the shaft 139 turns at a rotational speed *n* of between 5 and 40 rmp. Now the first operating step can begin, which involves admitting the treating liquid for example into the first drum 132.

FIRST OPERATING DATA

To carry out the first operating step the valves 159, 168, 169, 170, 153, 154 and 150 assume the positions 40, 50, 70, 75, 55, 65 and 60 illustrated in FIGS. 2 and 3. The pump 162 now pumps treating liquid through the line 160 and the line 157 from the reservoir 161 into the drum 131 until the level H1 is reached. When this level is reached, the float valve 158 closes the line 157. The line 165 is blocked by the valve 168 so that the liquid cannot flow out of the drum 132. The air in the interior 135 of the drum 132 can escape to the extent necessary through the line 151 during the inflow of the treating liquid. Since the shaft 139 rotates, the filamentary material packages 145 alternately dip into the liquid in the drum 132 and emerge therefrom, and in effect become only superficially wetted by this liquid.

SECOND OPERATING STEP

To initiate this operating step the valve 159, 168, 169, 170, 153, 154 and 150 are moved to the positions 41, 50, 70, 75, 56, 65 and 61. The line 151 is thus blocked by the valve 153 and the interior 135 of the drum 132 receives from the non-illustrated compressed air source compressed air via the reducing valve 149, the line 148 and the branch line 148′. The pressure P2 which now prevails in the interior 135 is greater than the pressure P3 in the chamber 147 which equals the pressure in the space 136. As a result, when a yarn package 145 enters into the liquid, the liquid is forced into the yarn package. As soon as the package emerges from the liquid, the compressed air in the interior 135 flows through the package 145 into the chamber 147 from where it can flow off via the tube 142 into the space 136 and from there via the lines 167 or 152. During the penetration of the compressed air through the package 145 the compressed air causes the liquid which has wetted the filamentary material of the package to foam, and evenly distributes this foam throughout the cross-section of the package 145, causing a homogeneous treatment of the filamentary material.

This is now followed by the third operating step during which the treating liquid and the compressed air are forced from the interior to the exterior of the package 145.

THIRD OPERATING STEP

To carry out the third operating step the valves 159, 168, 169, 170, 153, 154 and 150 must be in the positions 42, 51, 71, 75, 55, 65 and 60, respectively. The liquid from the drum 132 now can flow via the line 165 and the conduit 166 into the reservoir 161.

At the same time the pump 162 furnishes liquid via the line 160 and the line 155 into the interior 136. The line 167 is blocked and the air in the space 136 can be vented via the line 152. As soon as the level H2 has been reached in the drum 134 by the admitted treating liquid, the float valve 156 closes the line 155. The apparatus is now ready for the fourth operating step in which the liquid and the compressed air are alternately pressed through the packages 145.

FOURTH OPERATING STEP

For the fourth operating step the valves 159, 168, 169, 170, 153, 154 and 150 must be in the positions 41, 51, 71, 75, 55, 66 and 62. The line 152 is blocked and compressed air flows from the line 148 via the branch line 148″ into the drum 134. Since the shaft 139 rotates, the bent over ends of the tubes 142 alternately dip into the body of liquid in the drum 134. The overpressure P2 which prevails therein presses the liquid through the respectively immersed end portion of the tube 142 into the space 147, where the pressure P2 is greater than the pressure P3 in the drum 132. This means that the liquid is pressed into the package 145. As soon as the previously immersed end of the tube 142 emerges out of the liquid, the compressed air in the space 136 flows through the tube 142 into the chamber 147 and from there via the package 145 into the space 135 of the drum 132. In so doing, the compressed air causes the liquid which has entered into the package 145 to undergo foaming, and distributes it evenly over the entire cross-section of the package. After a revolution of the shaft 139 through 360° the operation is repeated.

If these operations begin with step 1, then this is followed sequentially by steps 2, 3 and 4. Depending upon the particular requirements made in a given situation, for example the type of filamentary material to be treated, the step 4 may again be followed by steps 1–4, that is the complete operation may be duplicated. It is also possible to begin with operating step 3 which is then followed sequentially by steps 4, 1 and 2. Here, again steps 3, 4, 1 and 2 may be repeated.

If it is necessary to transfer the liquid in one of the drums 132 or 134 into the other drum, then the valves 159, 168, 169, 170, 153, 154 and 150 are set to the positions 41, 51, 70, 76, 55, 66 and 62, respectively. This makes it possible for the liquid in one of the drums 132, 134 to be transferred under the pressure in this drum into the other drum, via the lines 165 and 167.

The length of time during which the packages 145 dip into the liquid in the drum 132 can be adjusted by changing the setting of the float 158′ on the float rod 158″, given a continuous rate of revolution of the shaft 139. The higher the level H1 is selected, the longer will be the period during which the package 145 will remain immersed. Analogously, a repositioning of the float 156′ can be used to change the period of liquid supply from the second drum 135 into the package 145.

It will be understood that each of the elements described above, or two or more together, may also find a useful application in other types of constructions differing from the types described above.

While the invention has been illustrated and described as embodied in the liquid treatment of filamentary materials, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention.

What is claimed as new and desired to be protected by Letters Patent is set forth in the appended claims:

1. A method of liquid-treating filamentary materials, such as threads, yarn and textiles, comprising the steps of confining a hollow package of filamentary material within a vessel so that the package subdivides the interior of the vessel into an inner and a separate outer chamber which communicate only through the thickness of the filamentary material; admitting a foamable treating liquid in unfoamed state into only one of said chambers; pressing an amount of said liquid from said one chamber into the filamentary material sufficient to wet the filamentary material without substantially any of said liquid entering the other chamber; discharging the residual, unfoamed liquid from said one chamber; and forcing a pressurized gaseous fluid through said package from one chamber into the other chamber to thereby foam the liquid within the filamentary material and evenly distribute it throughout said package.

2. A method as defined in claim 1, wherein the step of pressing is carried out by application of gaseous fluid in pressurized state.

3. A method as defined in claim 1, wherein the step of pressing is carried out until a predetermined upper level of differential pressure is reached between said chambers; and the step of forcing is carried out until a predetermined lower level of differential pressure is reached between said chambers.

4. A method as defined in claim 1, wherein the steps of admitting and pressing are carried out repeatedly before the step of forcing is carried out.

5. A method as defined in claim 1, wherein the steps of admitting and pressing are each carried out at least once in each one of said chambers.

6. Apparatus for liquid-treating filamentary materials, such as threads, yarn and textiles, comprising a treating vessel; first means for supporting within said vessel a package of filamentary material which is hollow and subdivides the interior of said vessel into an inner and an outer chamber which communicate only through the thickness of the filamentary material; second means for admitting a foamable treating liquid in unfoamed state into only one of said chambers; third means for pressing an amount of said liquid from said one chamber into the filamentary material of said package sufficient to wet the filamentary material and for preventing substantially any of said pressed liquid from entering the other chamber; fourth means for thereupon discharging residual, unfoamed liquid from said one chamber; and fifth means for forcing a pressurized gaseous fluid through said package from one to the other of said chambers to foam the liquid within the filamentary material and evenly distribute it throughout the package.

7. Apparatus as defined in claim 6; and further comprising means for establishing differential pressures between said chambers.

8. Apparatus as defined in claim 6; further comprising holding means in said vessel for holding said first means in a predetermined position relative to said vessel.

9. Apparatus as defined in claim 8, wherein said first means is a package tube having openings in its circumferential wall.

10. Apparatus as defined in claim 6; further comprising two pairs of fluid lines communicating with said vessel and with sources of said liquid and of compressed air; and valve means in said fluid lines for selectively connecting each of said chambers with one of said sources.

11. Apparatus as defined in claim 10; and further comprising a pressure gauge connected with each of said chambers.

12. Apparatus as defined in claim 6, wherein said vessel is a drum, and a hollow rotatable shaft extends axially into said drum and carries mounting means for said first means at a radial distance from the axis of rotation of said hollow shaft; a pair of first fluid lines each communicating with the interior of said drum and with a source of said liquid and of compressed air, respectively; a valve in the fliud line communicating with said source of said liquid and controlled by the liquid level in said drum; a fluid line communicating with said inner chamber and adapted for selective communication with both of said sources; and a motor for rotating said hollow shaft.

13. Apparatus as defined in claim 12, comprising a further drum adjacent the first-mentioned drum, said shaft extending through said further drum; fluid lines connecting said further drum with said sources, a valve responsive to the fluid level in said further drum being interposed in the fluid line connecting said further drum with said source of liquid.

14. Apparatus as defined in claim 13, wherein said valves are adjustable in dependence upon the desired liquid level in said drums.

15. Apparatus as defined in claim 12; and further comprising a change-speed gear interposed between said motor and said hollow shaft to regulate the speed of rotation of the latter.

* * * * *